United States Patent [19]

Song

[11] Patent Number: 4,846,720

[45] Date of Patent: Jul. 11, 1989

[54] BALUN TRANS AND FEEDER LINE CONNECTING DEVICE OF ANTENNA MATCHING ADAPTER FOR TELEVISION SET

[76] Inventor: Jae C. Song, 295-9, Jangan 1-dong, Dongdaemun-ku, Seoul, Rep. of Korea

[21] Appl. No.: 185,785

[22] Filed: Apr. 25, 1988

[30] Foreign Application Priority Data

Dec. 23, 1987 [KR] Rep. of Korea ..... 22864/1987

[51] Int. Cl.[4] ..... H01R 4/24

[52] U.S. Cl. ..... 439/407; 439/620; 439/409; 439/675

[58] Field of Search ..... 439/389–413, 439/417, 418, 620, 696, 731, 752, 675

[56] References Cited

U.S. PATENT DOCUMENTS

| | | | |
|---|---|---|---|
| 4,113,341 | 9/1978 | Hughes | 439/620 |
| 4,118,091 | 10/1978 | Frisby | 439/620 |
| 4,221,451 | 9/1980 | Petrolewicz et al. | 439/620 |
| 4,443,050 | 4/1984 | Taylor | 439/620 |
| 4,648,674 | 3/1987 | Sanchiz, Jr. | 439/395 |
| 4,679,885 | 7/1987 | Nestor et al. | 439/620 |
| 4,734,048 | 3/1988 | Giebel et al. | 439/409 |

*Primary Examiner*—David Pirlot

*Attorney, Agent, or Firm*—Fleit, Jacobson, Cohn, Price, Holman & Stern

[57] ABSTRACT

A BALUN trans and feeder line connecting device for the antenna matching adapter, which is connected to an F-connector for VHF mounted on the antenna terminal strip of a television set is disclosed. According to the invention, each outgoing line of the BALUN trans is connected to each corresponding connecting terminal of the shield side spring and hot side pin provided in the adapter body and to the connecting terminal of feeder line connecting piece, and the annealed copper stranded wire of the antenna feeder line is connected to the other end of the feeder line connecting piece, wherein a cut-off connecting groove in which the end of feeder line is fitted, is formed at the front end of each connecting terminal, and a pointed connecting portion consisting of both connecting blades and the intermediate groove is formed on the other side of the said feeder line connecting piece; a cover coupled with the adapter body is divided into two cover plates: one for the plug terminal connecting portion and the other for the feeder line connecting portion, which are to be opened and shut separately, and a pressing portion and a pressing piece are formed in a predetermined position inside of each cover plate. Coupling and connecting between each outgoing line and connecting terminal and between each feeder line and connecting piece is realized only closing the cover.

3 Claims, 4 Drawing Sheets

FIG, 1
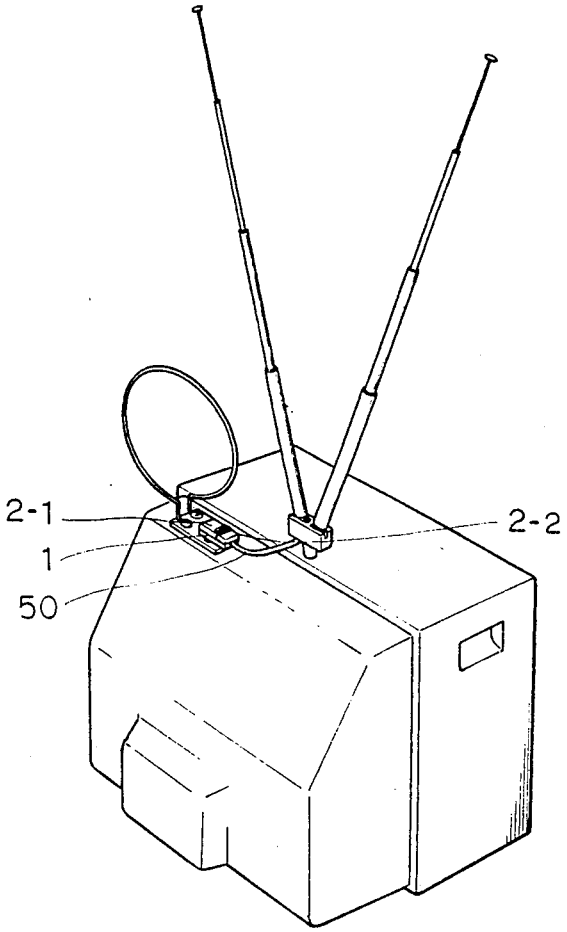

FIG, 2
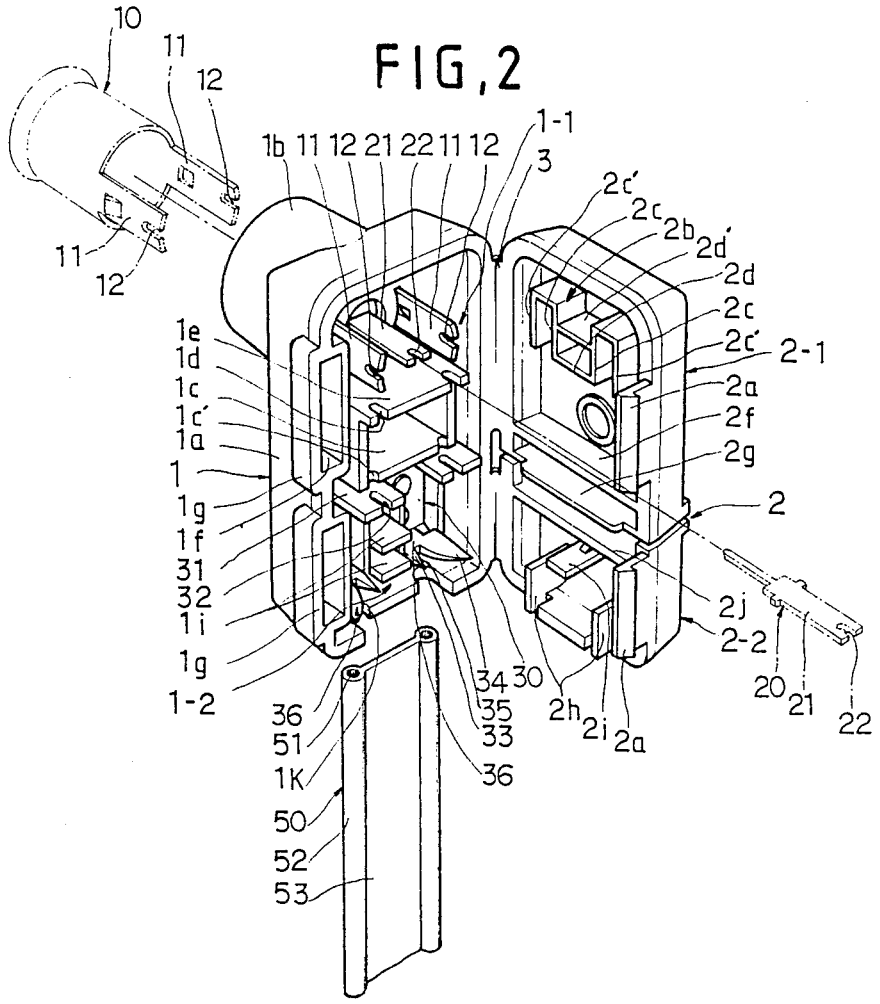

FIG, 3
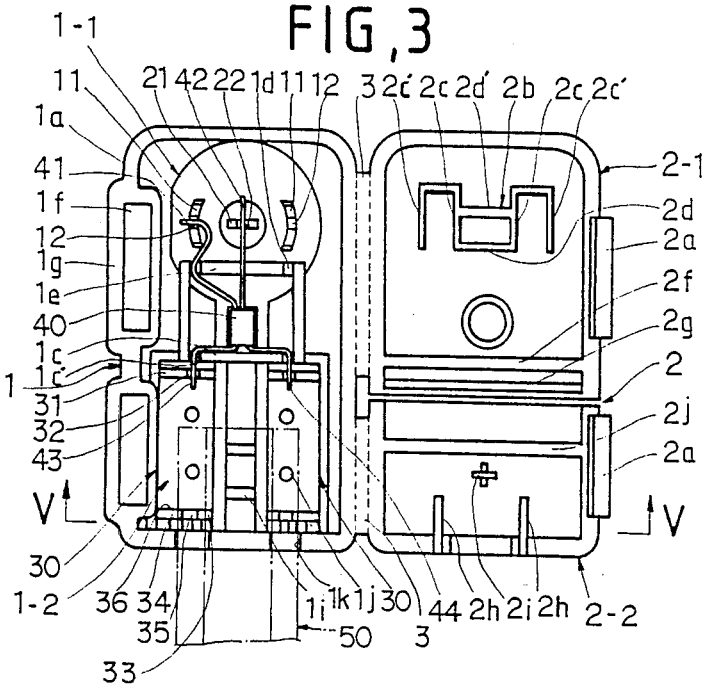
FIG, 4
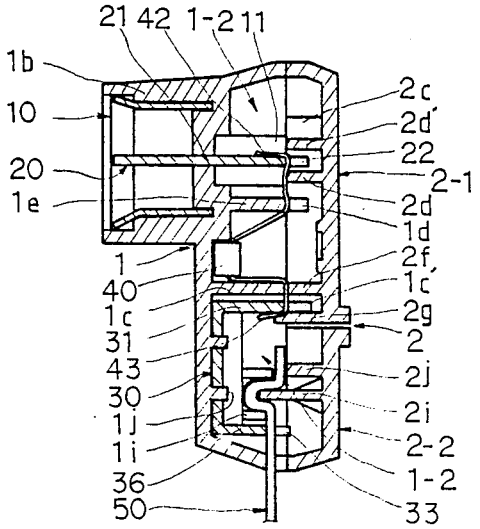

FIG,5
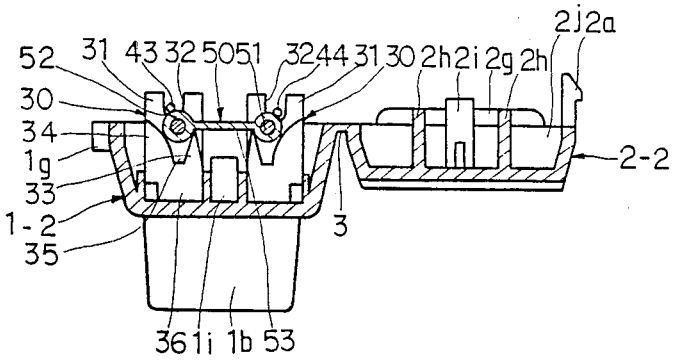
FIG,6
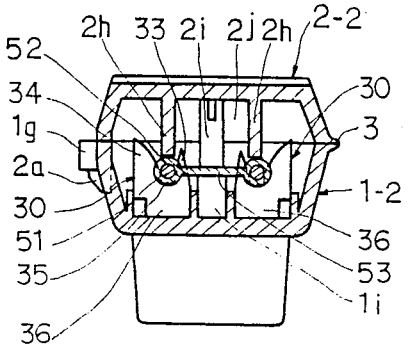
FIG,7
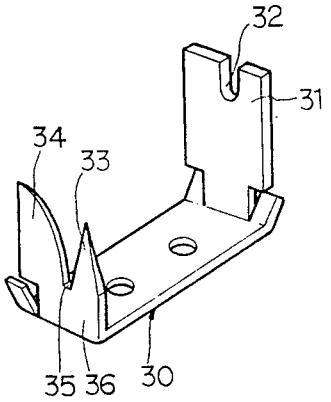

BALUN TRANS AND FEEDER LINE CONNECTING DEVICE OF ANTENNA MATCHING ADAPTER FOR TELEVISION SET

BACKGROUND OF THE INVENTION

The present invention relates to a BALUN trans (balanced-to unbalanced transformer) and a feeder line connecting device of an antenna matching adapter to be coupled to F-connector for VHF mounted on the antenna terminal strip of a television set, and particularly relates to a BALUN trans and a feeder line connecting device of antenna matching adapter for a television set, and more particularly to a connecting device which can connect easily the outgoing line of BALUN trans coupled with connecting terminals of a shield side spring, hot side pin and feeder line connecting piece respectively, and an antenna feeder line coupled with another end of the feeder line connecting piece.

On the antenna terminal strip of ordinary television set is mounted an exposed F-connector for VHF, and the connector is to be coupled with a matching adapter connected to the twin-lead type antenna feeder line, and on thus set up matching adapter is mounted a BALUN trans for matching the impedance on the input side put in through the feeder line from the antenna and the impedance on the output side applied to the tuner.

However, such conventional antenna matching adapter has a connecting structure which in connecting each outgoing line of the BALUN trans to the shield side spring and hot side pin coupled with F-connector for VHF and to the feeder line connecting piece respectively, they are deposited and fixed to each of connecting terminals of the shield side spring and hot side pin mounted in the body of adapter, and to the connecting terminal of both feeder line connecting piece, while on each feeder line connecting piece is mounted a particular fixing screw to be tightened outside the body of adapter, and the antenna feeder line is connected thereto with the fixing screw.

The conventional antenna matching adapter of such connecting structure has difficulties, inconveniences and problems in that a complicated and troublesome soldering is required to mount the BALUN trans to the conventional antenna matching adapter, and in coupling the twin-lead type antenna feeder line with the connecting piece, it is possible to connect the feeder line by winding each stripped-off annealed copper stranded wire around a fixing screw formed a separate part and tightening it, after stripping off one by one the insulated coated portion of each feeder line using a separate tool, so that its productivity falls remarkably, and its production cost has risen.

SUMMARY OF THE INVENTION

It is the principal object to provide the BALUN trans and feeder line connecting device for a television set which has not any diffculty and problem as described above.

It is another object to provide a BALUN trans and feeder line connecting device of antenna matching adapter for television set, which is designed to make a rapid and easy connection between the shield side spring, hot side pin and feeder line connecting piece and the outgoing line of BALUN trans, and also between the feeder line connecting piece and the feeder line, in such a way that the cover to be separated from and coupled with optionally the body of adapter is divided into that for a plug terminal connecting portion which consists of the shield side spring and the hot side pin, and that for a feeder line connecting portion; and that the cover for a plug terminal connecting portion is coupled with the body of adapter so that each outgoing line of the BALUN trans inserted in each connecting terminal groove of the shield side spring, hot side pin and feeder line connecting piece is connected simply with a pressing piece of each group formed opposite each other on the inner surface of the cover; and that as the cover for the feeder line connecting portion is coupled, the pressing piece formed on the inner surface presses the feeder line placed on the pointed portion of the feeder line connecting piece to break the coated portion of the feeder line, and make thereby contact directly each annealed copper stranded wire with the connecting piece.

BRIEF DESCRIPTION OF THE DRAWINGS

Embodiments of the invention will now be described in more detail, by way of example, with reference to the accompanying drawings.

In the drawings,

FIG. 1 is a perspective view showing an application example of the antenna matching adapter according to the invention;

FIG. 2 is a perspective view showing the inner constitution by developing the antenna matching adapter according to the invention;

FIG. 3 is a development plan view showing the state in which the BALUN trans is mounted on the antenna matching adapter according to the invention;

FIG. 4 is a longitudinal sectional view showing a coupled state of the antenna matching adapter according to the invention;

FIG. 5 and 6 is an operational view showing the process in which a feeder line is coupled with the antenna feeder line connecting piece by the antenna matching adapter according to the invention;

FIG. 5 is a sectional view showing a state in which the antenna feeder line is placed on the pointed portion of the connecting piece taken on the line V—V in FIG. 3, and FIG. 6 is a longitudinal sectional view showing a state in which the feeder line is coupled with the connecting piece as the cover plate is coupled with the feeder line connecting portion of the body of adapter; and FIG. 7 is a perspective view showing only an extracted feeder line connecting piece according to the invention.

DETAILED DECRIPTION OF THE INVENTION

FIG. 1 shows an example in which the adapter according to the invention is used in the television set, FIGS. 2 and 3 are a perspective view and a development plan view showing the inner constitution by opening the separate cover of the adapter according to the invention, and FIG. 4 is a longitudinal sectional view showing the coupling state. As shown in the drawings, in the antenna matching adapter for a television set, in which on one side of the adapter 1 covered by an optionally separable and remountable cover, both connecting terminals 11 of the shield side spring 10 inserted in a cylindrical portion 1b of the front face of the body 1 are projected inwards, respectively, and in the intermediate portion between the said connecting terminals 11, is fixed a connecting terminal 21 of the hot side pin 20 mounted on the central portion of the said cylindrical portion 1*b*, and on the other inner side of the adapter body 1 are mounted parallel to each other two feeder line connecting pieces 30 having connecting terminals 31 to which each annealed copper stranded wire 51 of the twin-lead type antenna feeder line 50; and to each of the said connecting terminal 11, 21, 31 is connected each of outgoing lines 41, 42, 43, 44 of the BALUN trans mounted on the central portion of the adapter body 1, a partition 1c of a specified height is provided across both sides of the main wall 1a of the body 1 in the central portion of the said adapter body 1 to divide the inside of the body 1 into the plug terminal connecting portion 1—1 and the feeder line connecting portion 1-2, and in the central portion of the plug terminal connecting portion 1—1 divided through an intermediate partition 1*c*, a guide piece 1e at the upper end of which several guiding grooves 1d are formed, is provided parallel to the partition 1c so that a certain distance is maintained between the guide piece 1e and the connecting terminal 11 of the said shield side spring 10 and the connecting terminal 21 of the hot side pin 20.

The ends of the connecting terminal 11 of the said shield side spring 10 and the connecting terminal 21 of the hot side pin 20, which are exposed in such adapter body 1 are provided respectively with connecting grooves 12, 22 cut off in a predetermined width and depth, and the outgoing lines 11, 42 on one side of the BALUN trans 40 mounted in the space portion between the said intermediate partition 1c and the guide piece 1e is destined to be engaged with the connecting grooves, respectively.

Moreover, each feeder line connecting piece 31 mounted in the said feeder line connecting portion 1-2 is bent to U-form in its whole shape, so that at the upper end of the connecting terminal 31 formed at one side of the said connecting piece is formed connecting grooves 32 in which outgoing lines 43, 44 on the other side of the said BALUN trans 40, are to be inserted and at the other end of each connecting piece 30 is provided a pointed connecting portion 36 in which two pointed connecting blades 33, 34 are formed on the inner and outer sides forming an intermediate concave groove 35 between them.

On the other hand, the cover 2 coupled with the said adapter body 1 is coupled at one side with the body 1 through a connecting piece 3 to be opened and shut rotating round the connecting piece 3, and the middle portion of the cover 2 is divided in the direction of its width into a cover plate 2-1 for the above-described plug terminal connecting portion and a cover plate 2—2 for the feeder line connecting portion so that each cover plate 2-1, 2—2 may be opened and shut separately. At a free end of each cover plate 2-1, 2—2, is formed a projecting portion 2 a which is inserted through a hooking holes 1f formed on both sides of the free end of the said body 1, and which is hooked and fixed on a hooking bar 1*g*.

In the inner middle portion of the cover plate 2-1 for such plug terminal connecting portion, is formed an outgoing line pressing portion 2*b* surrounding the inside and outside of each connecting terminal 11 mounted in the said body 1.

The said outgoing line pressing portion 2*b* is provided parallel in a certain distance with a pressing pieces 2*c*, 2*c*', 2*d* 2*d*' consisting of two pieces as a set so that as the cover plate 2-1 is put on, the upper portions of both connecting terminals 11 of the said shield side spring 10 and the connecting terminal 21 of the hot side pin 20 are to be inserted respectively between the pressing pieces 2*c*, 2*c*', 2*d* 2*d*' of each set.

At a separate end on the inside of the cover plate 2-1 for such plug terminal connecting portion, are formed two other pressing pieces 2*f*, 2*g* parallel to each other on the inside and outside in a certain distance so that as the cover plate 2-1 is put on, the end portion of the inner pressing piece 2f is to contact with the outer end of an intermediate partition 1c of the said body 1, while the end of its outer pressing piece 2*g* is to be adjacent to a side of the front end of the connecting terminal 31 of the said feeder line connecting piece 30.

On the other hand, on the inside of main lower wall of the cover plate 2—2 for the said feeder line connecting portion, two pressing pieces 2*h* having a predetermined width and height are mounted protrudently and parallel to each other so that as the cover plate 2-1 is put on, the outer end of each pressing piece 2*h* is to be inserted in the intermediate concave groove 35 of the pointed connecting portion 36 formed on one side of the feeder line connecting piece 30 provided in the said body 1. In the central inner portion of the cover portion 2-1, there is formed a pressing rib 2*i* opposite to a supporting rib 1i formed in the central portion of the feeder line connecting portion 1-2 of the said body 1, and on the inner side of the pressing rib 2*i*, there is formed another pressing piece 2*j* so as to press and fix the feeder line 50 inserted in the body 1.

In the drawings, the reference numeral 1*c*' is an outgoing line guide groove formed on the intermediate partition 1*c* of the said adapter body 1; 1*j* is a deposited projection to which each of the said connecting pieces 30 is fixed; and 1k represents an inserting groove of the feeder line.

The operating effect of thus constructed device according to the invention is described as follows.

For mounting a BALUN trans 40 to the plug terminal connecting portion 1—1 of the adapter body 1 according to the invention, and connecting the outgoing lines 41, 42, 43 44 to the connecting terminal 11 of the shield side spring 10 and the connecting terminal 21 of hot side pin 20, the said BALUN trans is in the first place inserted, as shown in FIG. 2 and 3, between the guiding piece 1e and the intermediate partition 1*c* formed in the middle portion of the body 1 in the open state of the cover plate 2-1 for the plug terminal connecting portion; the middle portion of the outgoing lines 41, 42 on a side is inserted through each guide groove 1d provided at the upper end of the guiding piece 1e; the end of each outgoing line 41, 42 is inserted in each connecting groove 12, 22 formed at the front end of the connecting terminal 11 on a side of the said shield side spring 10 and the connecting terminal 21 of the hot side pin 20; and then the outgoing lines 43, 41 on the other side of the BALUN trans 40 is inserted in the connecting groove 32 of the connecting terminal 31 of each connecting piece 30 mounted on the feeder line connecting portion 1-2 through each guide groove 1*c*' provided at the upper end of the intermediate partition 1*c*.

After the above-described steps are completed, when the opened cover plate 2-1 is put on, the fastening protrusion 2*a* formed at the free end of the cover plate 2-1 is fitted in the hooking hole 1f formed in the body 1 and is caught and fastened to the hooking bar 1*g*, and at the same time, as shown in FIG. 4, the front end of the connecting terminal 21 of the said hot side pin 20 is inserted between the inner and outer pressing pieces *2d* *2d'* in the middle of the pressing portion *2b* formed in the middle of the inside of the cover plate 2–1, and the front end of the connecting terminal 11 of the outer shield side spring 10 is inserted between the said inner and outer pressing pieces *2c 2c'* so that the end of each outgoing line fitted in the inserting groove 22, 12 of each of the said connecting terminal 21, 11 is pressed by the front end of each pressing pieces *2d 2d'*, *2c, 2c'*, and thereby adhered closely to the inserting groove 22, 12 of each connecting terminal 21, 11, and at the same time the end is bent and become contact closely with the outer side of each connecting terminal 21, 11.

The pressing piece 2f formed on the inner side of the separate end of the cover plate 2–1 comes in contact with the front end of the intermediate partition 1*c* of the body 1 concurrently with a contacting action of the outgoing lines 41, 42 on the said side, and presses thereby each outgoing lines 43, 44 fitted in each guide groove, 1*c'* and at the same time the front end of the outer pressing piece *2g* presses the end of outgoing lines 43, 44 inserted in the connecting groove 32 of each connecting terminal 31 and thereby make it be adhered closely in such a manner as described above so that each outgoing line 41, 42, 43, 44 may contact simply and easily with the connecting terminals 11, 21, 31.

For connection of the feeder line 50 to the feeder line connecting portion 1–2 of the body 1 in the said state, it is required to open the cover plate 2—2 for the feeder line connecting portion, as shown in FIG. 2 and 3, and then to make one end of the feeder line 50 locate on the feeder line connecting portion 1–2 of the body 1. When the opened cover plate 2–1 is coupled in such a manner as described above in a state that the covered portion 52 of the annealed copper stranded wire 51 provided on both sides is put on the upper side of the intermediate concave groove 35 formed on the pointed connecting portion 36 of the said connecting piece 30, the front end of the pressing pin *2h* protruded on both sides of the outer end of the cover plate 2–1 presses strongly the covered portion 52 of the annealed copper stranded wire placed in the said intermediate concave groove 35, so that as the covered portion 52 is pushed into the intermediate concave groove 35, a connecting 33 provided on its one side pierces an intermediate coupling portion 53 and breaks the inside of the covered portion 52, and at the same time breaks also the outside of the covered portion 52 with the opposite connecting blade 34, and thereby the partially stripped-off inner annealed copper stranded wire 51 is inserted closely in both sides of the intermediate groove 35 and a connection between the feeder line and the connecting piece 30 is realized in a simple way.

According to the connecting device for antenna matching adapter of the invention, as described above, each connecting terminal of the shield side spring and the hot side pin mounting in the adapter body and the connecting terminal of the feeder line connecting piece is coupled with each outgoing line of the BALUN trans; the other end of the said feeder line connecting piece is coupled with the annealed copper stranded wire of the antenna feeder line, in which the front end of the said connecting terminal is provided with a cut-off connecting groove to be engaged with an end of the feeder line, and the other side of the said feeder line connecting piece is provided with a pointed connecting portion consisting of both connecting blade portions and an intermediate concave groove; the cover coupled with the adapter body is divided into a cover plate for the plug terminal connecting portion and a cover plate for the feeder line connecting portion, which are to be opened and shut separately, and a pressing portion and a pressing piece are formed in a predetermined position respectively, in the inner face of each cover plate; and it is possible to connect rapidly each outgoing line of the BALUN trans to each of the said connecting terminals, and to connect the feeder lines to the connecting pieces. Thus, the connecting device of the antenna matching adapter according to the invention has an effect that it is possible to exclude the complicated and troublesome soldering and feeder line stripping work, and to carry out simply and easily the coupling and connecting work between the BALUN trans and the feeder lines without using particular parts and tools, such as fixing screws, drivers, etc., so that the manufacturing cost is reduced remarkably, the productivity is improved preeminently, and the connecting conditions between the outgoing lines and the connecting terminals, and between the connecting pieces and the feeder lines, to be coupled with each other are maintained exactly and stably.

What is claimed is:

1. A BALUN trans and feeder line connecting device of an antenna matching adapter for a television set comprising:

a cover having cover plates, an adapter body covered by said cover to be opened and shut optionally, a shield side spring and a hot side pin each having connecting terminals with both connecting terminals mounted on one inner side of the adapter body, two feeder line connecting pieces having connecting terminals with the connecting terminals mounted on the other side of the adapter body, a plurality of outgoing lines of a BALUN trans connected to each of the connecting terminals, an antenna feeder line having annealed copper stranded wires with the wires connected to said feeder line connecting pieces, a partition formed on a middle portion of the adapter body and having a guiding piece, a pointed connecting portion to which the feeder line is connected, formed at the other end of each of the feeder line connecting pieces, a pressing portion and a pressing piece formed in an inner face of one of the cover plates of the cover to press and to contact the ends of outgoing lines inserted in the connecting portion, and two pressing pieces formed in the other of the cover plates of the cover in parallel to press the annealed copper stranded wires of the feeder line placed on the pointed connecting portions of the feeder line connecting pieces.

2. The connecting device as claimed in claim 1, wherein the pressing portion formed on the inner face of the cover plate for the plug terminal connecting portion consists of pressing pieces two of which form a set, which are mounted parallel to each other at a predetermined distance.

3. The connecting device as claimed in claim 1, wherein the pointed connecting portion mounted on one side of the said connecting piece is formed by two pointed connecting blades between which is provided an intermediate concave groove.

* * * * *